United States Patent [19]

Fournier

[11] Patent Number: 4,907,905

[45] Date of Patent: Mar. 13, 1990

[54] COIL-BOUND NOTEBOOK

[75] Inventor: James L. Fournier, N. Bennington, Vt.

[73] Assignee: JLF Designs, Inc., N. Bennington, Vt.

[21] Appl. No.: 253,856

[22] Filed: Oct. 5, 1988

[51] Int. Cl.[4] ..... B42F 13/00; B42F 13/04; B42D 3/00

[52] U.S. Cl. ..... 402/80 R; 402/57; 281/31

[58] Field of Search ..... 402/57, 58, 59, 80 R; 281/31, 32, 33, 34, 35, 36, 37

[56] References Cited

U.S. PATENT DOCUMENTS

| | | | |
|---|---|---|---|
| 1,516,932 | 11/1924 | Staab | 402/26 |
| 1,970,285 | 8/1934 | Douvry | 402/19 |
| 2,051,738 | 8/1936 | Ottinger | 402/19 |
| 2,061,675 | 11/1936 | Schade | 402/79 X |
| 2,228,355 | 1/1941 | Key | 402/26 |
| 2,299,715 | 10/1942 | Tauber | 281/27.1 |
| 2,327,941 | 8/1943 | Tauber | 281/27.1 |
| 2,602,251 | 7/1952 | Friedman | 402/57 |
| 3,526,415 | 9/1970 | Freundlich | 281/27.1 |
| 4,120,517 | 10/1978 | Staats | 281/19.1 |
| 4,629,349 | 12/1986 | Pitts | 281/31 |
| 4,636,179 | 1/1987 | Gentile et al. | 402/80 R |

FOREIGN PATENT DOCUMENTS

| | | | |
|---|---|---|---|
| 250903 | 12/1966 | Austria | 402/57 |
| 2443547 | 10/1975 | Fed. Rep. of Germany | 402/57 |
| 3447461 | 12/1984 | Fed. Rep. of Germany | 402/80 R |
| 327288 | 4/1930 | United Kingdom | 402/80 R |
| 633147 | 12/1949 | United Kingdom | 402/80 R |

*Primary Examiner*—Douglas D. Watts
*Assistant Examiner*—Paul M. Heyrana, Sr.
*Attorney, Agent, or Firm*—Fish & Richardson

[57] ABSTRACT

A notebook adapted for replacement of leaves has a helical binding coil disposed along a coil axis; a first cover leaf defining apertures along a binding edge; a second cover leaf defining apertures along a binding edge adjacent the binding edge of the first cover leaf; multiple leaves having coinciding apertures along associated edges, the spacing between apertures of the first and second cover leaves and the multiple leaves corresponding generally to spacing between turns of the coil; and an elongated handle element associated with one end of the coil and extending transverse to the coil axis. The handle element is adapted for rotation about the coil axis to advance the binding coil along the axis for engaging and disengaging the coil in apertures of the leaves. The handle may be secured to a cover leaf with the binding coil engaged in the apertures.

4 Claims, 2 Drawing Sheets

COIL-BOUND NOTEBOOK

The invention relates to a coil bound notebooks with removal bindings for insertion of replacement leaves.

Others have thought to provide a coil-bound notebook having the coil removable for insertion and removal of leaves or pages. For example, Key U.S. Pat. No. 2,228,355 describes a loose-leaf spiral notebook having a coil with a short extended end engaged by a pivoting latch.

SUMMARY OF THE INVENTION

According to the invention, a notebook adapted for replacement of leaves comprises a helical binding coil element disposed along a coil axis, a first cover leaf defining a multiplicity of apertures along a binding edge, spacing between apertures of the first cover leaf corresponding to spacing between turns of the helical binding coil element, a second cover leaf defining a multiplicity of apertures along a binding edge adjacent the binding edge of the first cover leaf, spacing between the apertures of the second cover leaf generally corresponding to spacing between turns of the helical binding coil element, multiple leaves having coinciding apertures along associated edges, the spacing between apertures of the multiple leaves corresponding generally to spacing between turns of the helical binding coil element, an elongated handle element associated with one end of the helical binding coil element and extending transverse to the coil axis, and the handle element adapted for rotation about the coil axis to advance the binding coil element along the coil axis for engaging and disengaging the binding coil in the apertures of the leaves, and means associated with a cover leaf for securing the handle with the helical binding coil element engaged in the apertures.

Preferred embodiments of the invention may include the following features. The handle and the helical binding coil element are integrally formed. The means for securing the handle comprises a flap associated with another edge of a cover leaf and means for securing the flap to the cover leaf with the handle disposed therebetween. The notebook first cover leaf and the second cover leaf are connected along the binding edges. The notebook further comprises a strip-form element extending along the binding edges and secured at intervals to the notebook, portions of the strip-form element between points of securement defining apertures of the first and second cover leaves.

Other features and advantages of the invention will be apparent from the following description of a presently preferred embodiment and from the claims.

DESCRIPTION OF THE PREFERRED EMBODIMENTS

We first briefly describe the drawings.

STRUCTURE

Figure 1:
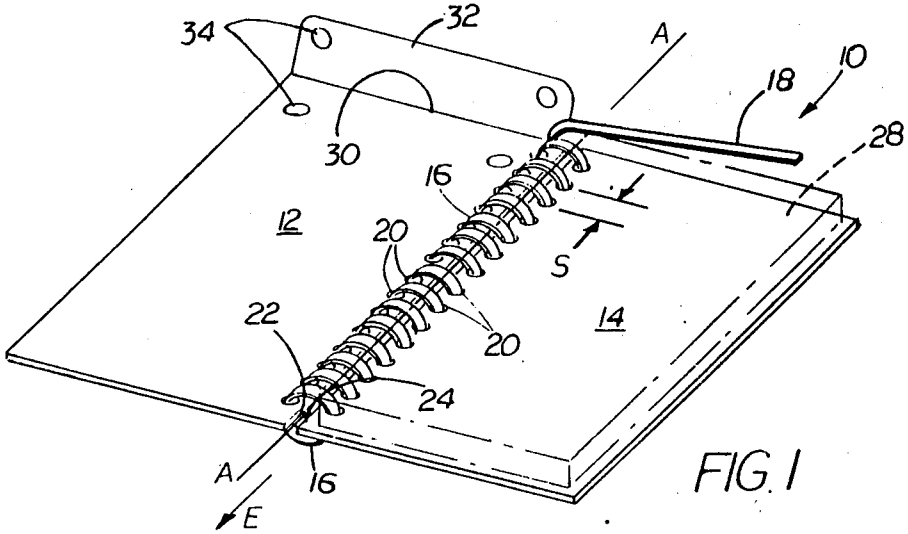
FIG. 1 is a perspective view of a helical coil notebook in accordance with the present invention.

Referring to FIG. 1, a coil bound notebook 10 consists of a first (front) cover leaf 12 and a second (rear) cover leaf 14 and a helical coil element 16 disposed along a coil axis A and terminating at one end in an elongated handle element 18 extending transversely to the coil axis A. The cover leaves 12, 14 each define a multiplicity of apertures 20 along adjacent binding edges 22, 24. Apertures 20 along each binding edge are spaced apart by a distance, S, corresponding generally to the spacing between the turns of the coil 16, the coil extending through the apertures 20 of the cover leaves, and through the coinciding apertures 26 of multiple paper leaves 28 (shown in dashed line in FIG. 1) having generally the same spacing. At the top edge 30 of front cover leaf 12 there is provided a flap 32 which folds over the handle 22 and is secured, e.g., by snaps 34 or Velcro hook-and-eye-type connectors for holding the handle in place.

OPERATION

Figure 2:
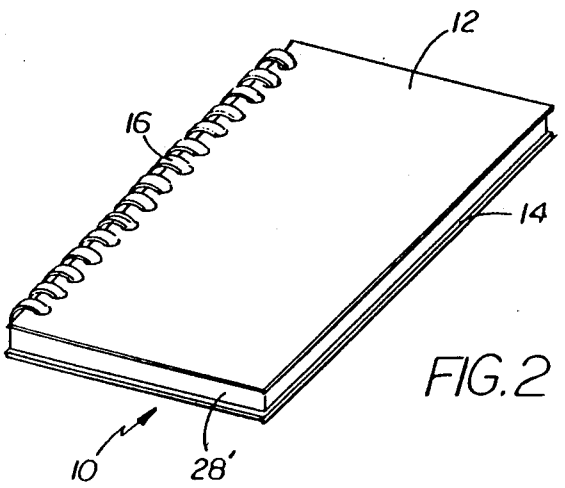
FIG. 2 is a similar view of a stack of replacement leaves for the notebook of FIG. 1.

To replace notebook pages or leaves 28 or to insert new leaves 28' (FIG. 2), snaps 34 are disengaged and flap 32 raised to permit disengagement of handle 18. The handle is rotated about axis, A, in a counter-clockwise direction to advance the coil element 16 along axis A in a direction (indicated by arrow R) thereby to disengage the binding coil from the cover leaves 12, 14, and from any remaining pages 28. The aperture 26 of the replacement notebook page are placed in alignment with the apertures 20 of the cover leaves. Then, again using elongated handle 18, the coil is rotated in a clockwise direction to advance the coil along axis A in a direction indicated by arrow E, thereby to engage the turns of the coil in the apertures of the cover and replacement leaves to securely assemble the replacement pages 28 with the covers. When binding 16 is advanced fully through apertures 20, 26, handle 18 is stored beneath flap 32, and the flap 32 is secured to cover 12 by snaps 34.

Figure 4:
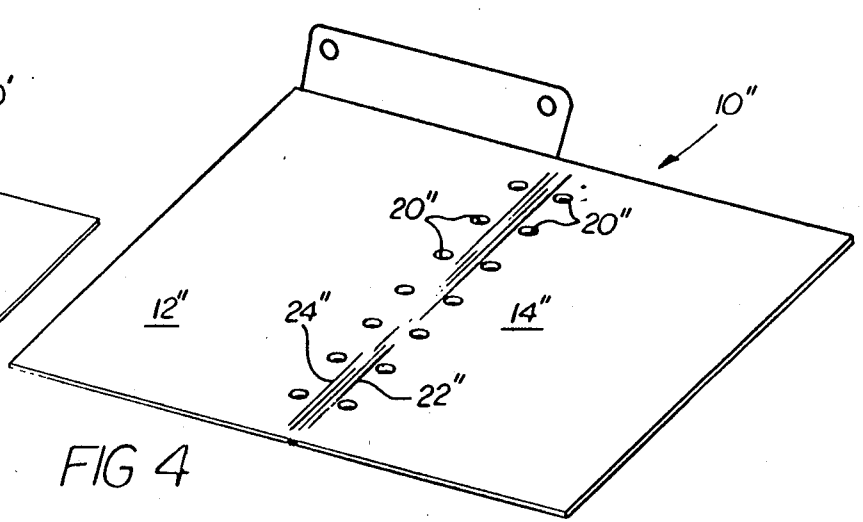
FIGS. 3, 4 and 5 are similar views of other embodiments of cover leaves of a notebook in accordance with the present invention.
Figure 3:
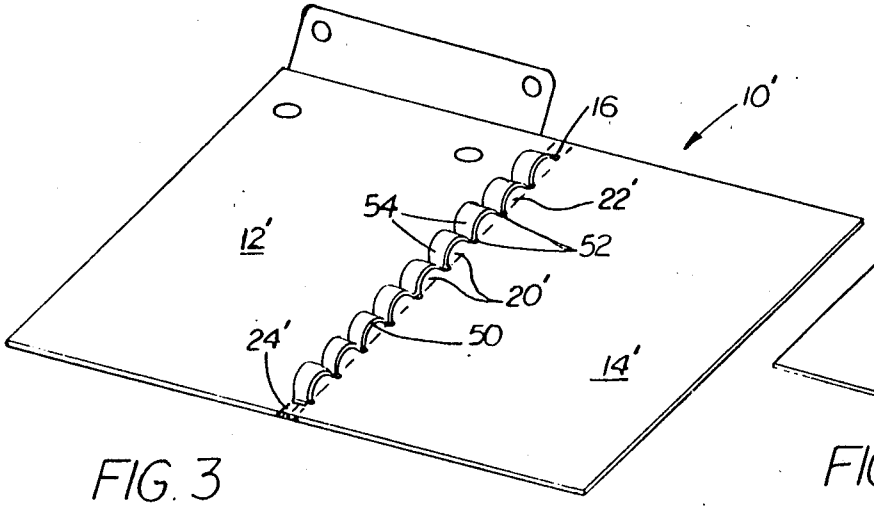
Figure 5:
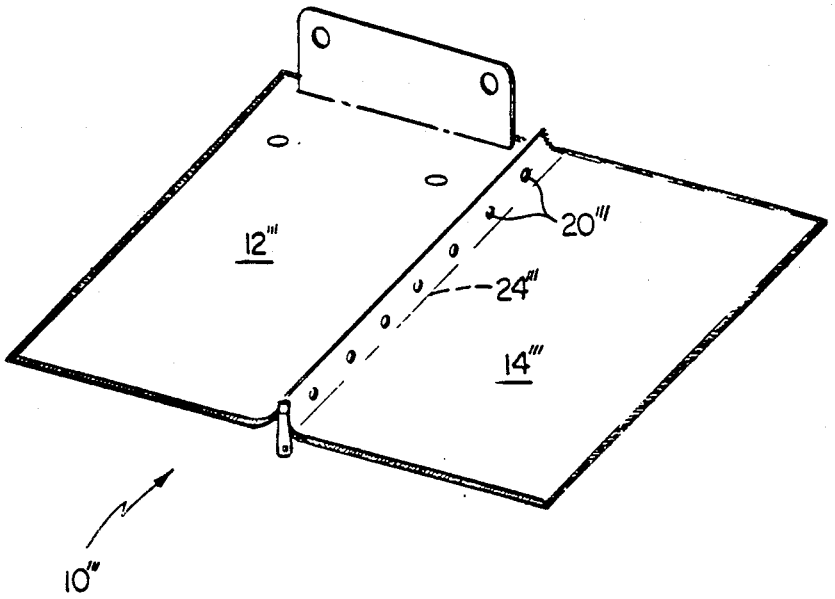

Other embodiments are within the following claims. For example, referring to FIG. 3, in notebook 10', front cover leaf 12' and rear cover leaf 14' are connected along their adjacent binding edges and a strip-form element 50 extends along the binding edges and is secured at intervals 52 to form loops 54 defining apertures 20' for receiving the turns of the coil 16. In FIG. 4, the front and rear cover leaves 12'', 14'' of notebook 10'' are integrally formed and define apertures 20'' for receiving the turns of a coil 16 (not shown). In FIG. 5, the front and rear cover leaves 12''', 14''' of notebook 10''' are integrally formed with zipper 40 attached to the outer edges of the front and rear leaves. Zipper 40 is attached such that there is a raised edge 42 defining apertures 20''' for receiving the coil.

What is claimed is:

1. In a coil bound notebook comprising a helical binding coil element disposed along a coil axis and terminating in an elongated handle element extending transversely to said coil axis, and a notebook body comprising a first cover leaf defining a multiplicity of first binding apertures disposed along a binding edge with spacing corresponding to spacing between turns of said helical binding coil element, a second cover leaf defining a multiplicity of second binding apertures disposed along a binding edge with spacing corresponding to spacing between turns of said helical binding coil element, and multiple leaves having coinciding leaf binding apertures along associated edges with spacing corresponding to spacing between turns of said helical binding coil element, turns of said helical binding coil element extending through aligned first, leaf and second binding apertures of said notebook body, in sequence, to bind said notebook, whereby, upon rotation of said handle in a first direction, said coil is advanced along said coil axis relative to said notebook body to release said leaves, and upon rotation of said elongated handle element in a second direction, said coil is retracted along said coil axis relative to said notebook body to rebind said leaves, the improvement wherein said first cover leaf further comprises a flap extending generally along an edge adjoining said binding edge, said flap hinged for movement between a first position securely enclosing said elongated handle element and a second position exposing said elongated handle element for rotation of said helical binding coil element, and means for securing said flap to said first cover leaf in said first position.

2. The notebook of claim 1 wherein said elongated handle element and said helical binding coil element are integrally formed.

3. The notebook of claim 1 wherein said first cover leaf and said second cover leaf are joined generally along said binding edges.

4. The notebook of claim 3 wherein said notebook further comprises a strip-form element extending between and generally along said first and second binding edges, said strip-form element secured at intervals, portions of said strip-form element between points of securement defining, with said first and second cover leaves, said first and second apertures of said notebook body.

* * * * *